US009950329B2

(12) United States Patent
Hou et al.

(10) Patent No.: US 9,950,329 B2
(45) **Date of Patent: *Apr. 24, 2018**

(54) HIGH PRESSURE WATER CLEANER WITH DETACHABLE WATER TANK

(71) Applicant: ACTIVE PRODUCTS INTERNATIONAL LIMITED, Hong Kong (CN)

(72) Inventors: James S. T. Hou, Toronto (CA); Simon Treadwell, Toronto (CA); Ming Liu, Toronto (CA)

(73) Assignee: ACTIVE PRODUCTS INTERNATIONAL LIMITED, Wanchai (HK)

( * ) Notice: Subject to any disclaimer, the term of this patent is extended or adjusted under 35 U.S.C. 154(b) by 110 days.

This patent is subject to a terminal disclaimer.

(21) Appl. No.: 14/581,611

(22) Filed: Dec. 23, 2014

(65) Prior Publication Data

US 2015/0183006 A1 Jul. 2, 2015

Related U.S. Application Data

(63) Continuation-in-part of application No. 13/155,362, filed on Jun. 7, 2011, now Pat. No. 8,955,531.

(51) Int. Cl.
*B05B 9/043* (2006.01)
*B08B 3/02* (2006.01)

(52) U.S. Cl.
CPC ..... *B05B 9/043* (2013.01); *B08B 3/026* (2013.01)

(58) Field of Classification Search
CPC ..... B65D 21/00–21/086; B05B 9/043; B08B 3/026
See application file for complete search history.

(56) References Cited

U.S. PATENT DOCUMENTS

| | | | | |
|---|---|---|---|---|
| 3,759,416 | A | 9/1973 | Constantine | |
| 4,798,060 | A * | 1/1989 | Long | B60H 1/3202 261/140.1 |
| 5,146,647 | A | 9/1992 | Blase et al. | |
| 5,533,671 | A | 7/1996 | Baer | |
| 5,762,411 | A | 6/1998 | Yemini | |
| 6,158,673 | A | 12/2000 | Toetschinger et al. | |
| 7,556,210 | B2 | 7/2009 | Mandell et al. | |
| 2008/0190930 | A1 * | 8/2008 | Vogel | B65D 21/0222 220/276 |
| 2009/0173753 | A1 | 7/2009 | Conner et al. | |
| 2012/0241014 | A1 | 9/2012 | Wise | |

FOREIGN PATENT DOCUMENTS

GB 2273040 A 6/1994

OTHER PUBLICATIONS

Examiner's Report for corresponding Canadian Application No. 2742634; Canadian Intellectual Property Office; dated Feb. 17, 2016.

* cited by examiner

*Primary Examiner* — Spencer E Bell
(74) *Attorney, Agent, or Firm* — Roberts Mlotskowski Safran Cole & Calderon P.C.; Jorie L. Stroup

(57) ABSTRACT

A high pressure water cleaner with detachable water tank includes a water cleaner main unit having an internal hydraulic pump, a top receptacle and a feed water connector in the receptacle in communication with the hydraulic pump, and a water tank detachably insertable into the receptacle and lockable to the receptacle by a movable lock.

15 Claims, 12 Drawing Sheets

HIGH PRESSURE WATER CLEANER WITH DETACHABLE WATER TANK

TECHNICAL FIELD

The present invention relates to water cleaners and more particularly to a high pressure water cleaner with detachable water tank in which the water cleaner can be nested in the water tank.

BACKGROUND

When using a conventional high pressure water cleaner, the operator might encounter the following two problems. One is that there is no water tap available or it is restrictive to connect a hose to a water tap. In this case, the high pressure water cleaner becomes useless. The other problem is that it is impossible to achieve a satisfactory cleaning effect just by using high pressure water cleaner only. For example, when cleaning car tires, car internals, motorcycles or machine, it is required to use extra cleaning hand tools (such as towels, brushes, etc.) to perform a further cleaning work.

In another exemplary use case, the operator might have an issue in that she wishes to use the high pressure water cleaner for a portion of a task, and manual application of water from a reserve water tank (such as a bucket) for the other portion of the task. An illustrative example would be for cleaning a vehicle, wherein typically an operator will (i) spray down the vehicle the high pressure water cleaner to remove debris, (ii) manually apply soapy water using a sponge, cloth or brush, (iii) possibly spray down the vehicle with the high pressure water cleaner aided by a soapy discharge of the water cleaner, and (iv) spray down the vehicle again with plain water using the high pressure water cleaner to remove the soap. In these cases, it is necessary to use the high pressure water cleaner and a bucket, the latter as a reservoir for the water that will be manually applied. However, space can be wasted during transport and storage of both the water cleaner and the bucket.

SUMMARY

In one aspect, a high pressure water cleaner apparatus is provided, the apparatus comprising: a water cleaner main unit adapted in operation to output high pressure water given a low pressure input water supply, the water cleaner main unit comprising top, bottom, and side walls; and a water tank comprising bottom walls and peripheral walls, the water tank peripheral walls comprising a support structure adapted to retain thereon the water cleaner main unit when the water cleaner main unit is nested within the water tank.

The support structure may be defined by the upper lip of the water tank peripheral walls. The water cleaner main unit may comprise one or more protrusions adapted to rest upon the upper lip of the water tank peripheral walls. The protrusions may comprise fins disposed vertically along the side walls of the water cleaner main unit. The protrusions may comprise a lip partially or fully encompassing the side walls of the water cleaner main unit. The protrusions may comprise a rim partially or fully encompassing the side walls of the water cleaner main unit.

The support structure may alternatively be disposed along the inner surface of the water tank peripheral walls. The support structure may be complementary to a stepped structure formed along the outer surface of the water cleaner main unit peripheral walls defined by its side walls. The support structure may be complementary to a stepped structure formed along the outer surface of the water cleaner main unit peripheral walls defined by two of its side walls, its top wall, and its bottom wall. The support structure may include a plurality of vertical fins adapted to support the water cleaner main unit. The support structure may be vertically part way along the water tank peripheral walls. The support structure may be vertically deeper along the water tank peripheral walls than the height of the water cleaner main unit.

The water cleaner main unit may further comprise a receptacle located on a top side thereof for receiving said water tank.

The water cleaner main unit may further comprise a movable lock adapted for locking said water tank to said receptacle.

The water cleaner main unit may further comprise a hydraulic pump mounted therein for enhancing the pressure of supplied water, a regulator for regulating water pressure and water flow rate, an electrical drive for driving said hydraulic pump, and a water outlet in communication with said hydraulic pump for connecting to a spray gun.

The movable lock may comprise a locking handle pivotally connected to said water cleaner main unit and a hook located on the free end of said locking handle for hooking on said water tank.

The water tank may further comprise a carrying handle pivotally connected to a top edge thereof.

The electrical drive may consume either one of AC power or DC power.

The water cleaner main unit may further comprise a rechargeable battery mounted therein and electrically connected to said electrical drive.

The water tank may further comprise a retainer located on the periphery for engaging said movable lock.

The water tank may further comprise a bottom flange fitting to said receptacle of said water cleaner main unit.

The retainer of said detachable water tank may have a recessed hole for receiving said movable lock, and a transverse rod suspending in said recessed hole for engaging of said movable lock.

The movable lock may comprise a locking handle pivotally connected to said water cleaner main unit and a hook located on the free end of said locking handle for hooking on said transverse rod of said retainer of said water tank.

DETAILED DESCRIPTION

The following provides a high pressure water cleaner with detachable water tank. In embodiments, the following also provides a high pressure water cleaner with corresponding water tank wherein the water tank and a main unit of the high pressure water cleaner are adapted to be nested to facilitate convenient transport and storage. This is accomplished by providing an inner peripheral surface of the water tank that is complementary to the outer peripheral surface of the water cleaner main unit, permitting nesting of the water cleaner main unit within the water tank.

Figure 1:
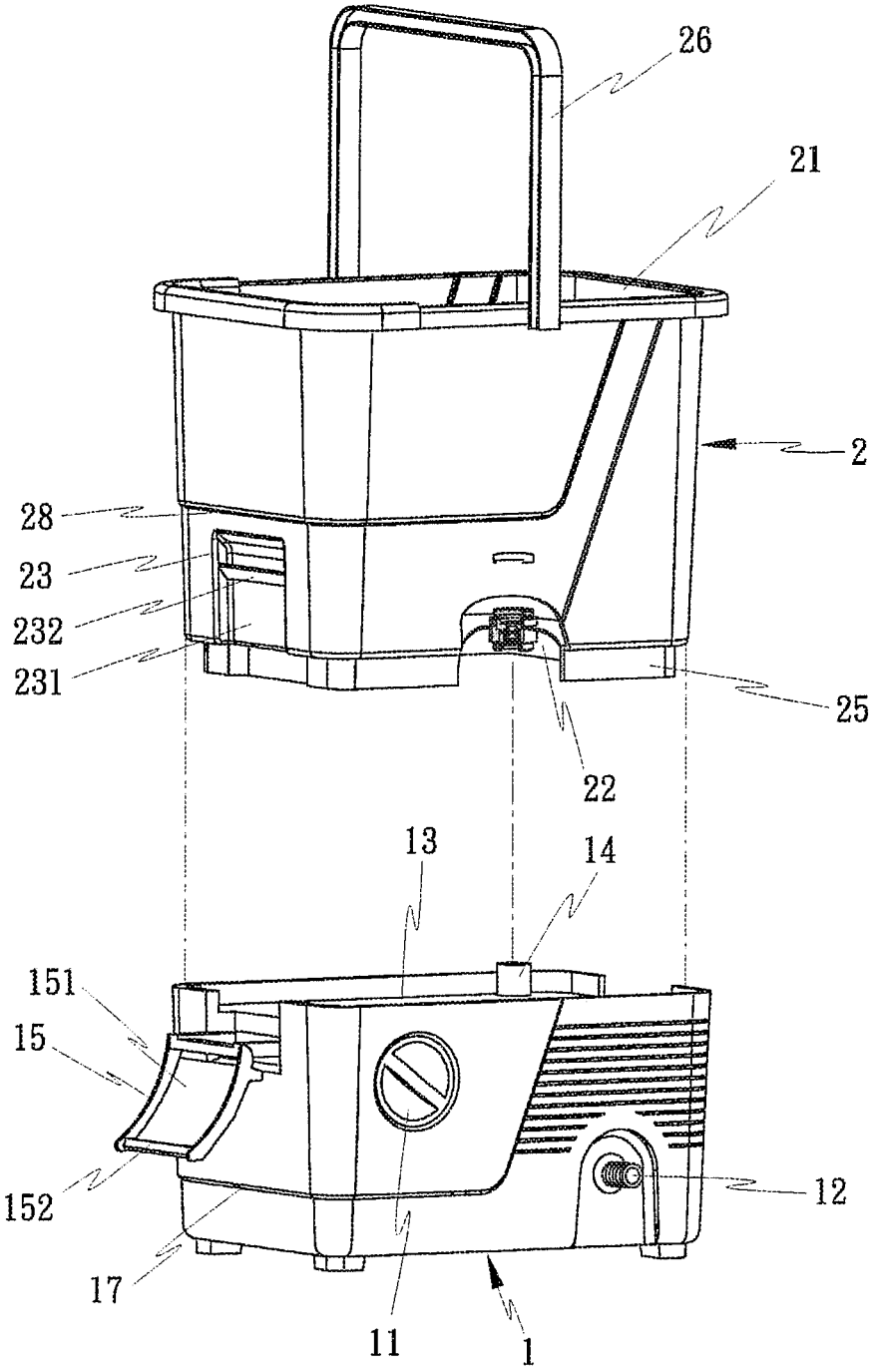
FIG. 1 illustrates a split status of the high pressure water cleaner with detachable water tank high pressure water cleaner with detachable water tank in accordance with the present invention.
Figure 2:
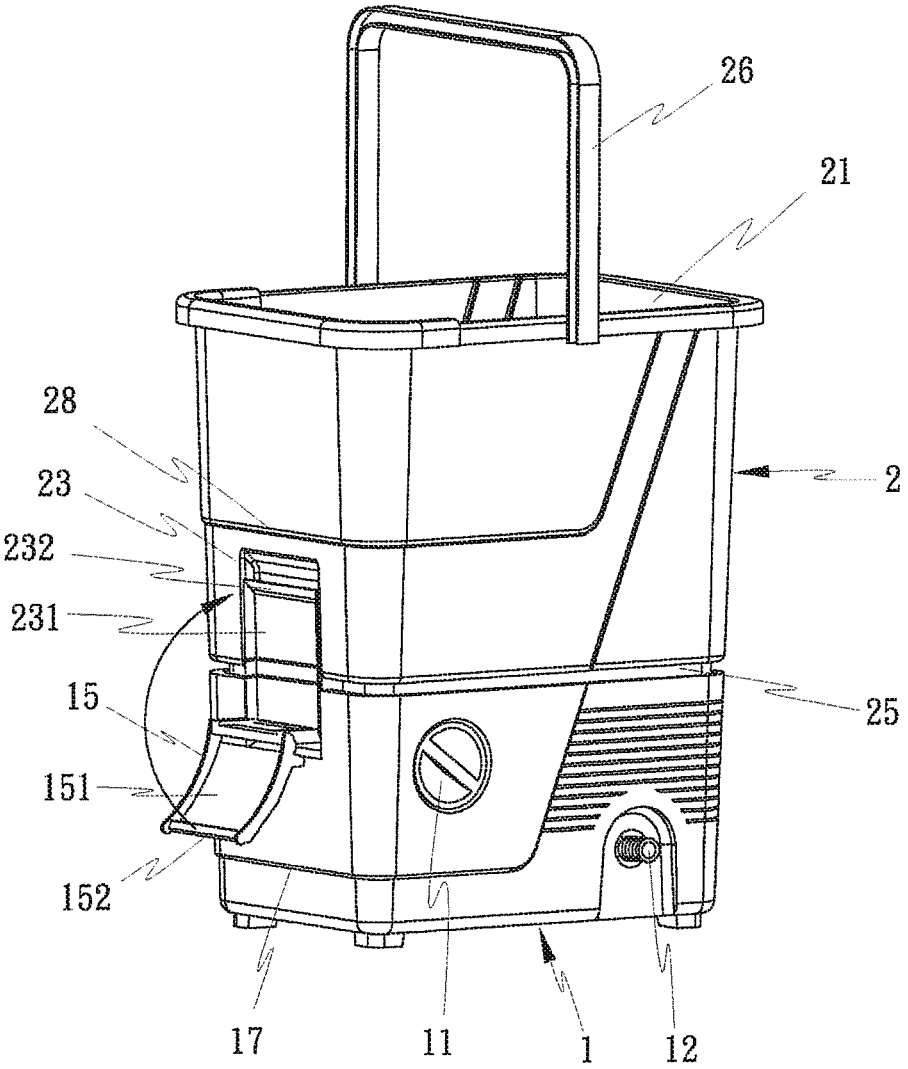
FIG. 2 is an elevational assembly view of the high pressure water cleaner with detachable water tank in accordance with the present invention.

As shown in FIGS. 1 and 2, the high pressure water cleaner with detachable water tank comprises a water cleaner main unit 1 and a detachable water tank 2.

The water cleaner main unit 1 can be made in any of a variety of shapes. According to this embodiment, the water cleaner main unit 1 has a rectangular shape. The water cleaner main unit 1 comprises a hydraulic pump (not shown) mounted on the inside and adapted for enhancing the pressure of supplied water, a regulator 11 for regulating water pressure and water flow rate and an electrical drive (not shown) for driving the hydraulic pump. The water cleaner main unit 1 has a water outlet 12 disposed at one lateral side thereof in communication with the internal hydraulic pump for the connection of a spray gun, a receptacle 13 located on the top side thereof for receiving the detachable water tank 2, a feed water connector 14 upwardly protruding from the bottom wall of the receptacle 13 and disposed in communication with the internal hydraulic pump, and a movable lock 15 adapted for locking the detachable water tank 2 to the receptacle 13. Thus, the detachable water tank 2 can be detachably secured to the receptacle 13 of the water cleaner main unit 1.

Figure 8:
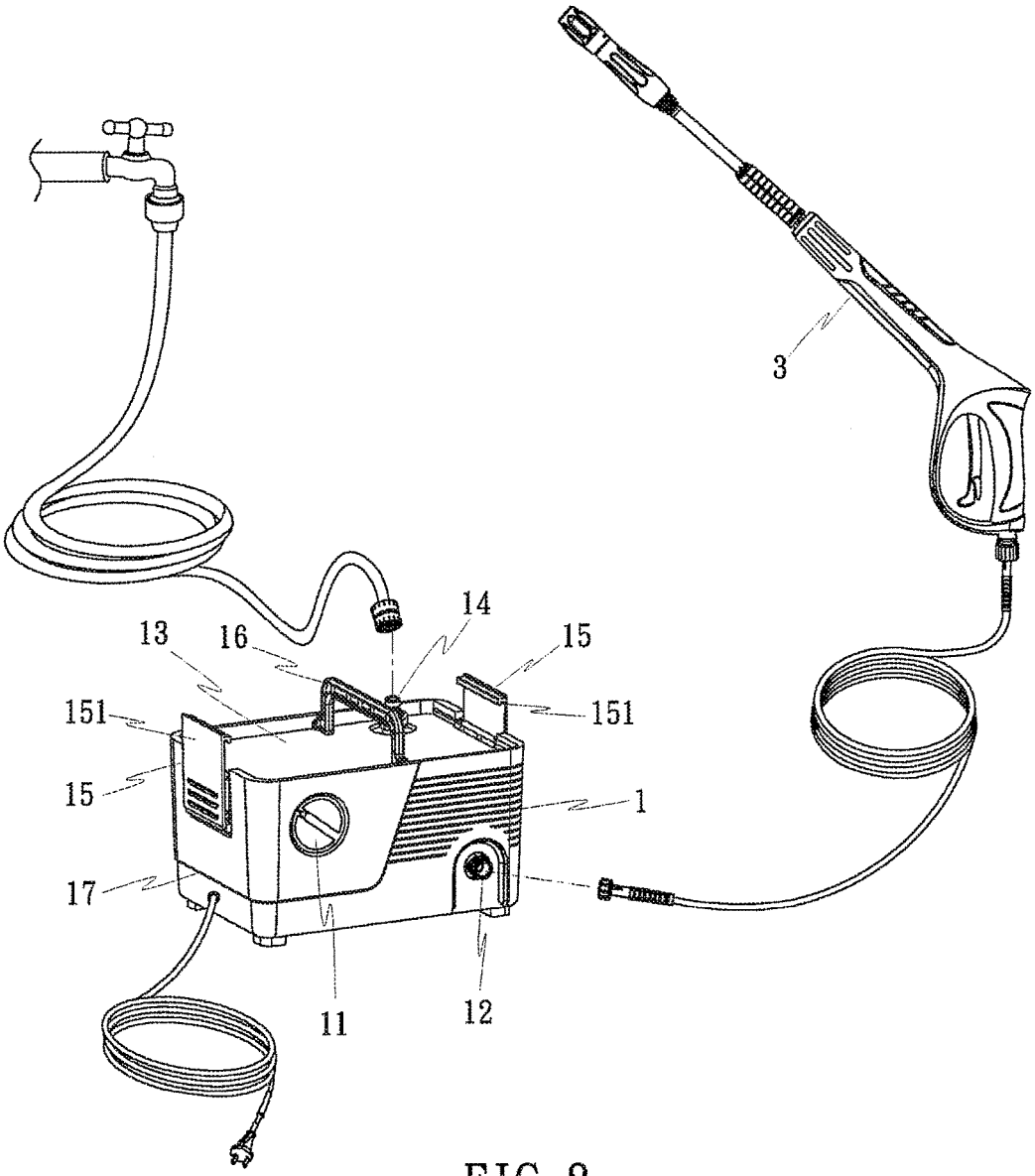
FIG. 8 is a schematic drawing of the present invention, showing another application example of the high pressure water cleaner with detachable water tank.

Referring to FIG. 8, a carrying handle 16 is pivotally connected to the receptacle 13 of the water cleaner main unit 1 to facilitate carrying by hand. The movable lock 15 according to this embodiment comprises a locking handle 151 pivotally connected to the water cleaner main unit 1. The locking handle 151 has a hook 152 at its free end for hooking on the detachable water tank 2. Further, the aforesaid electrical drive can use AC power (city power) as well as DC power. A rechargeable battery (not shown) is installed in the water cleaner main unit 1 for providing the necessary working voltage to the electrical drive. Thus, the high pressure water cleaner with detachable water tank can be used in different situations.

Referring to FIGS. 1 and 2 again, the detachable water tank 2 is detachably connected to the receptacle 13 of the water cleaner main unit 1, having a top opening 21, a check valve 22 located on the bottom side for connection to the feed water connector 14, and a retainer 23 for receiving the locking handle 151 of the movable lock 15. Thus, the detachable water tank 2 can be secured to the water cleaner main unit 1 for use with the water cleaner main unit 1, or separated from the water cleaner main unit 1 for independent application.

Figure 3:
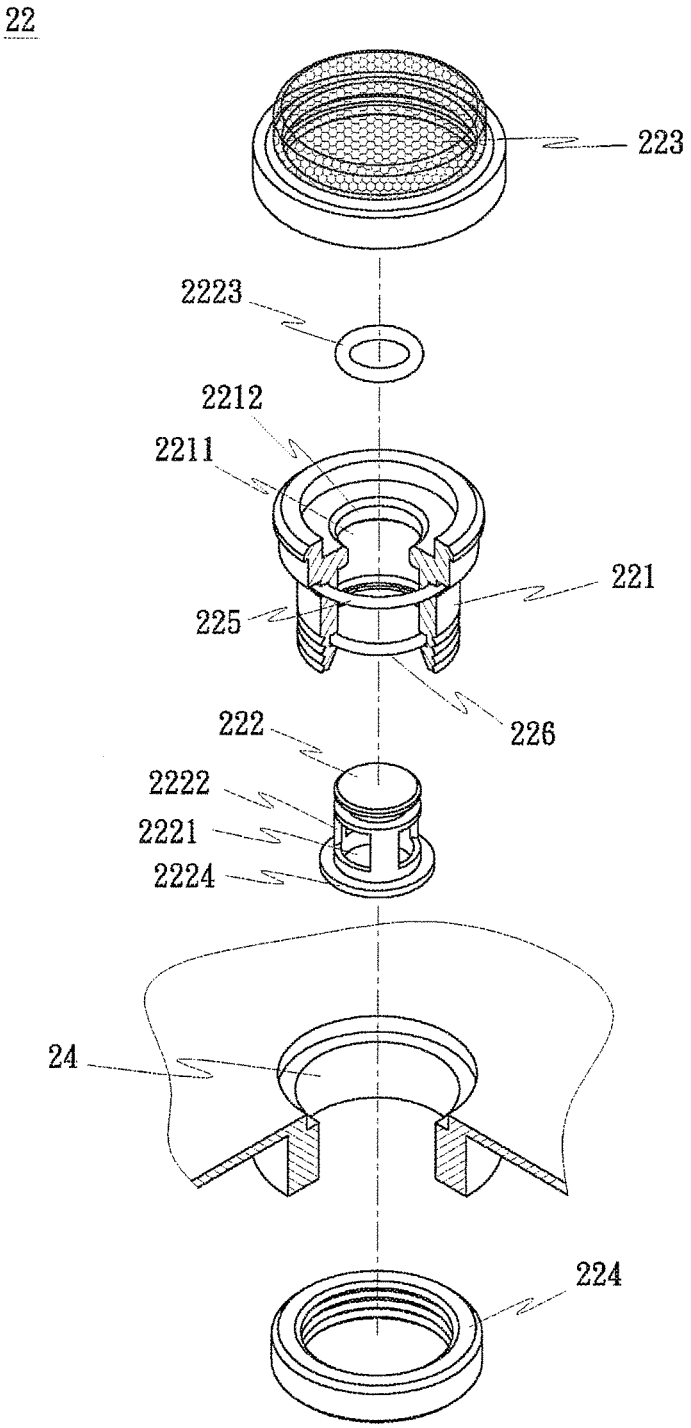
FIG. 3 is an exploded view of the check valve of the detachable water tank of the high pressure water cleaner with detachable water tank in accordance with the present invention.
Figure 4:
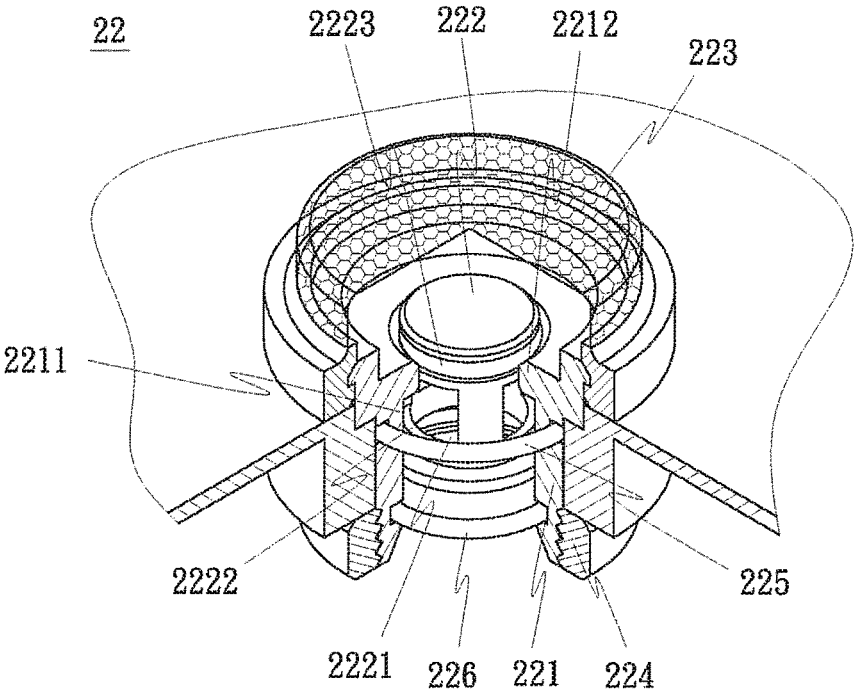
FIG. 4 is a sectional elevation of the check valve of the detachable water tank of the high pressure water cleaner with detachable water tank in accordance with the present invention.
Figure 5:
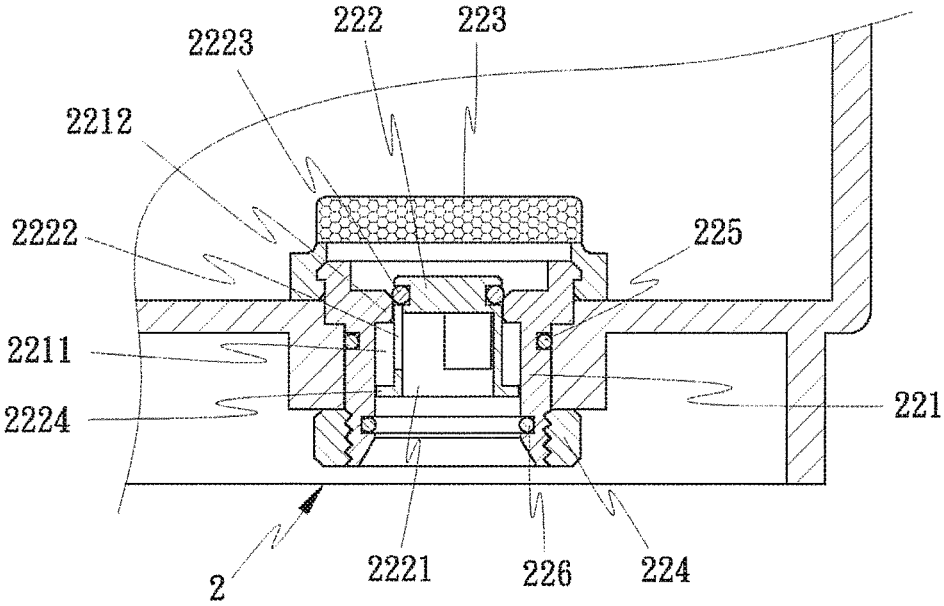
FIG. 5 is a sectional side view of the check valve of the detachable water tank of the high pressure water cleaner with detachable water tank in accordance with the present invention.
Figure 6:
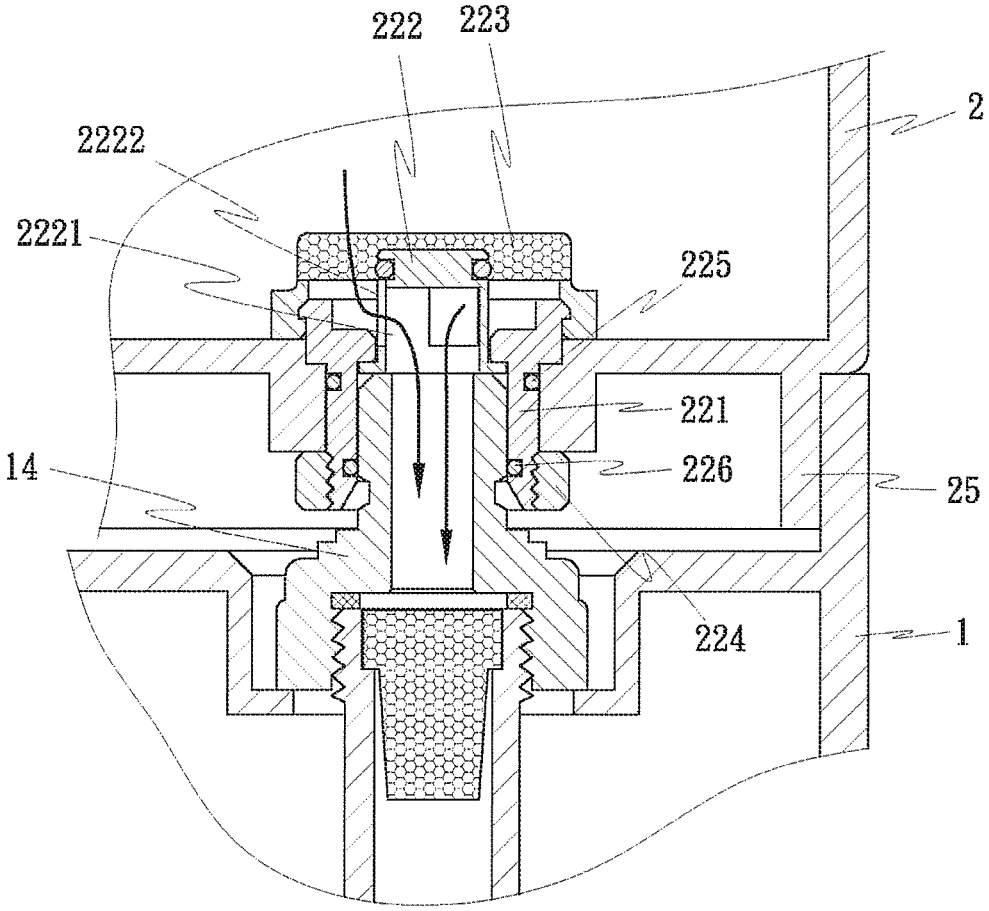
FIG. 6 is a schematic drawing of a part of the present invention, showing an operation status of the check valve.

Referring to FIGS. 3-5, the detachable water tank 2 has a drain hole 24 cut through the bottom wall thereof. The check valve 22 is installed in the drain hole 24, comprising a valve body 221, a valve hole 2211 at the center of the valve body 221 and a movable plug 222 mounted in and axially movable relative to the valve hole 2211. As shown in FIG. 6, when the valve hole 2211 of the check valve 22 is attached to the feed water connector 14, the movable plug 222 is moved relative to the valve hole 2211 to open the passage of the valve hole 2211 for allowing a cleaning solution (e.g. water) to pass from the detachable water tank 2 through the valve hole 2211 into the water cleaner main unit 1. On the contrary, when the detachable water tank 2 is removed from the water cleaner main unit 1, the movable plug 222 is returned to its former position to close the passage of the valve hole 2211, preventing the cleaning solution (water) from leaking. Thus, based on the design of the check valve 22, the detachable water tank 2 can be secured to the water cleaner main unit 1 for use with the water cleaner main unit 1, or separated from the water cleaner main unit 1 for independent application.

Referring to FIGS. 3-5 again, the check valve 22 further comprises an inside annular flange 2212 suspending in the valve hole 2211 for the passing of the movable plug 222. The movable plug 222 has a blind hole 2221 axially extending to its one end, namely, the bottom end, a plurality of radial holes 2222 disposed in communication with the blind hole 2221 and spaced around the periphery, a gasket ring 2223 fastened to the periphery near its other end, namely, the top end, and a stop flange 2224 extending around the periphery at the bottom end and stoppable at the bottom side of the inside annular flange 2212 of the valve body 221. Further, a wire gauze filter 223 is fastened to one end of the valve body 221, as shown in FIG. 6, for removing solid matters from the cleaning solution (water) passing through the check valve 22 toward the water cleaner main unit 1. A lock member, for example, lock nut 224 is fastened to the other end of the valve body 221 to lock the check valve 22 to the drain hole 24 of the detachable water tank 2. Further, in order to avoid cleaning solution leakage, one or a number of O-rings 225 are fastened to the periphery of the valve body 221 to seal the gap between the valve body 221 and the drain hole 24. A number of O-rings 226 may be fastened to the internal wall of the valve hole 221 to seal the feed water connector 14 of the water cleaner main unit 1.

Referring to FIGS. 1 and 2 again, the detachable water tank 2 has a bottom flange 25 fitting the receptacle 13 of the water cleaner main unit 1. By fitting the bottom flange 25 with the receptacle 13 of the water cleaner main unit 1, the detachable water tank 2 can be quickly coupled to the water cleaner main unit 1. The retainer 23 of the detachable water tank 2 has a recessed hole 231 for receiving the locking handle 151 of the movable lock 15, and a transverse rod 232 suspending in the recessed hole 231 for receiving the hook 152 at the free end of the locking handle 151.

Referring to FIG. 2 again, a carrying handle 26 is pivotally connected to the detachable water tank 2 at the top to facilitate carrying by hand. By means of the carrying handle 26, a user can carry the detachable water tank 2 to a water source to take water and then carry the detachable water tank 2 to the water cleaner main unit 1 for installation or to any desired place for independent application.

Figure 7:
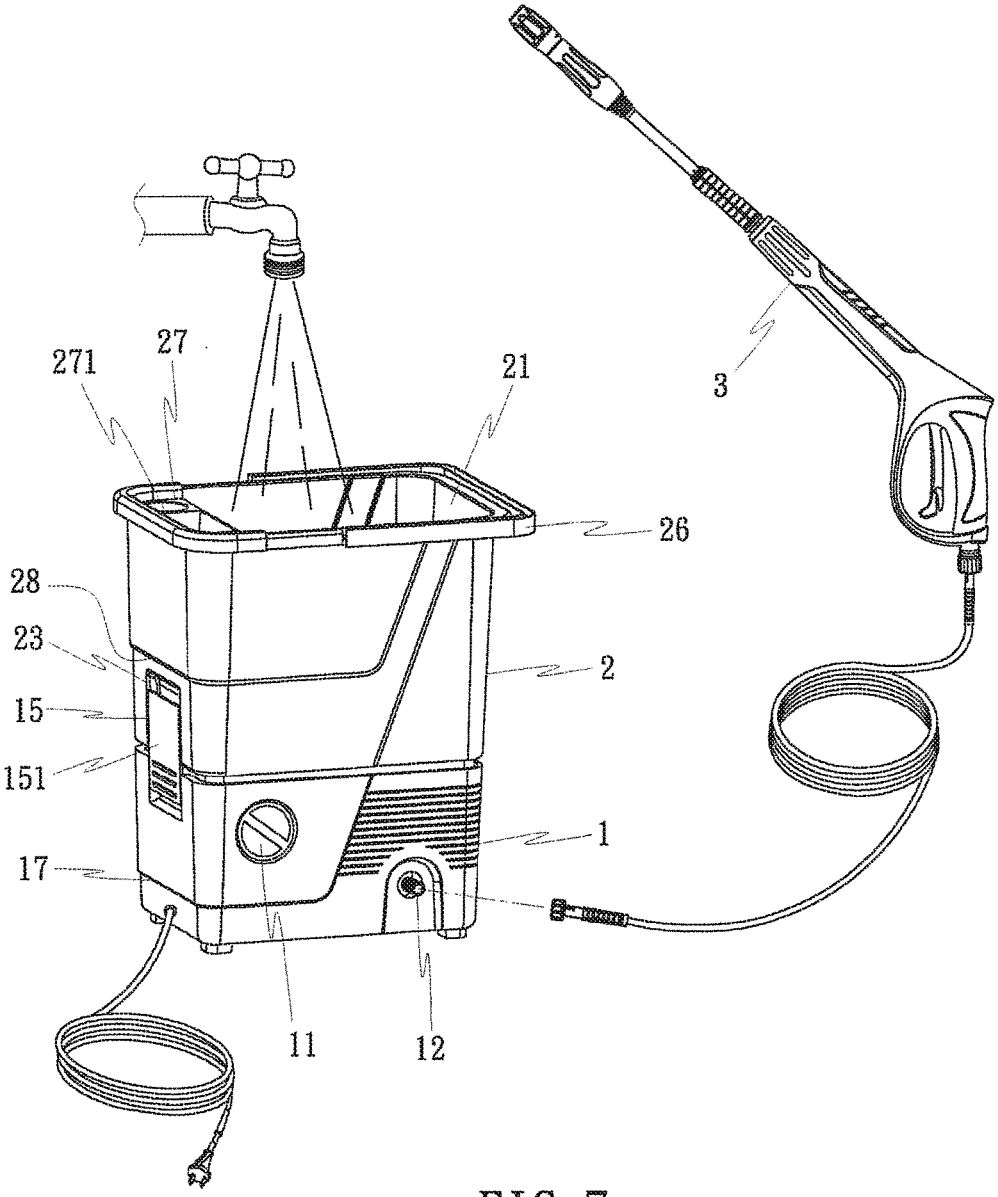
FIG. 7 is a schematic drawing of the present invention, showing an application example of the high pressure water cleaner with detachable water tank.

Referring to FIG. 7, the detachable water tank 2 has a nozzle gun rest 27 for the resting of the nozzle gun 3. The nozzle gun rest 27 has a recessed hole 271. When not in use, the nozzle gun 3 can be rested in the recessed hole 271 of the nozzle gun rest 27.

When using the high pressure water cleaner with detachable water tank, as shown in FIG. 7, the detachable water tank 2 can be installed in the water cleaner main unit 1 and moved with the water cleaner main unit 1 to a water source to take water. Alternatively, the detachable water tank 2 can be separated from the water cleaner main unit 1 and carried by hand to a water source to take water. After the detachable water tank 2 is filled up with water or other cleaning solution, it is carried to and installed in the water cleaner main unit 1. Further, as shown in FIG. 8, the water cleaner main unit 1 can be separately used. When using the water cleaner main unit 1 separately, connect the feed water connector 14 to a water source or city water tap by a hose, and then connect the nozzle gun 3 to the water outlet 12 for high pressure water cleaning. Further, the detachable water tank 2 can be separately used for holding a cleaning solution for cleaning, or for holding water for washing a cleaning tool. Thus, the high pressure water cleaner with detachable water tank meets different cleaning requirements, and eliminates the drawbacks of the prior art high pressure water cleaners.

Figure 9:
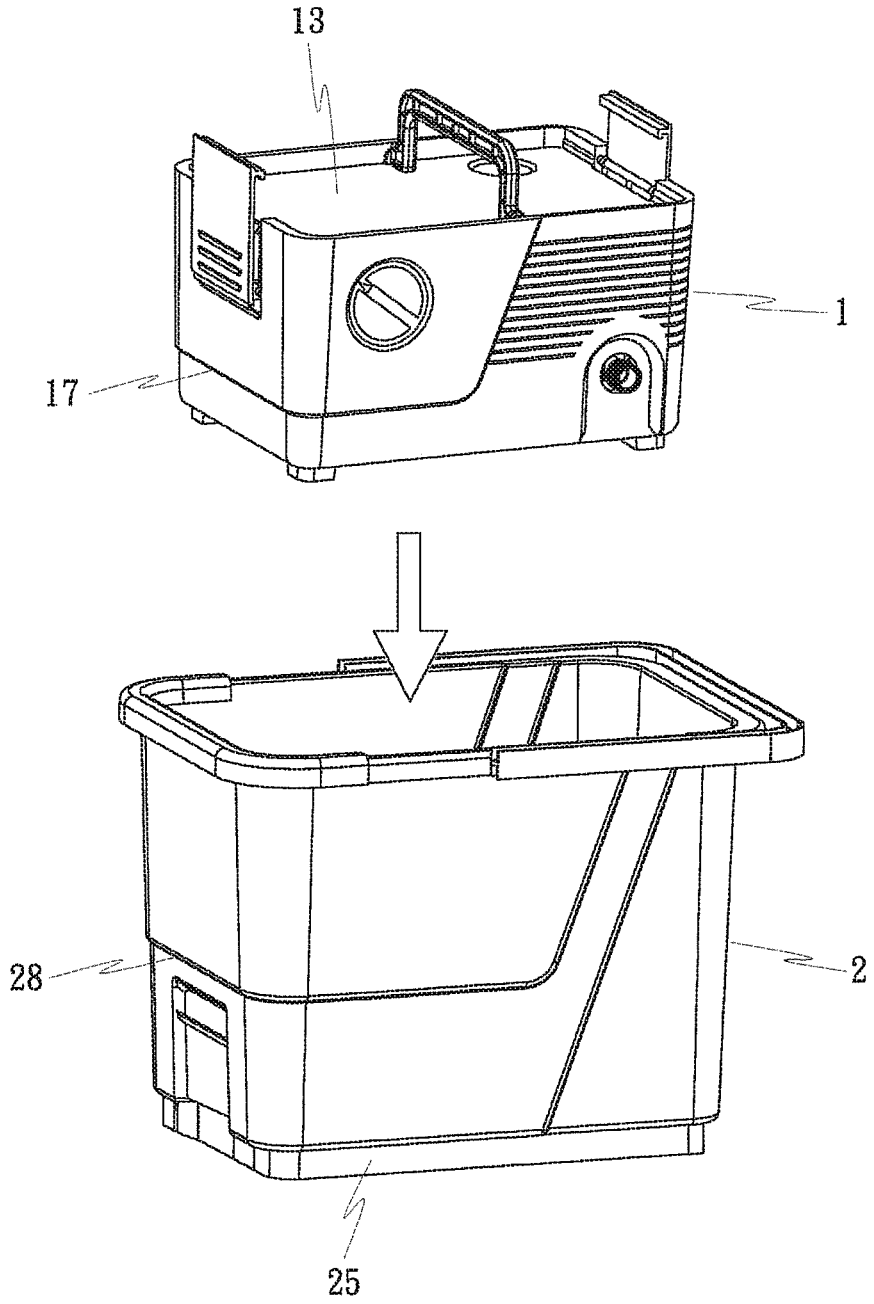
FIG. 9 illustrates a schematic drawing showing a storage status of the high pressure water cleaner with detachable water tank in accordance with the present invention.

Further, as shown in FIG. 9, when the high pressure water cleaner with detachable water tank is not used, the water cleaner main unit 1 can be received in the detachable water tank 2 to minimize storage space, thus facilitating movement and storage. Further, the water cleaner main unit 1 has a stepped structure 17 on the periphery. Further, the detachable water tank 2 has a support structure 28 located on the inside corresponding to the stepped structure 17 of the water cleaner main unit 1. When the water cleaner main unit 1 is inserted into the detachable water tank 2, the stepped structure 17 of the water cleaner main unit 1 is stopped and supported at the support structure 28. Thus, the water cleaner main unit 1 can be steadily positioned in the detachable water tank 2.

In another embodiment, the previously described water cleaner main unit 1 and water tank 2 can be adapted to be nesting but not necessarily with the purpose of assembly and water communication from the water tank 2 to the water cleaner main unit 1. In other words, the water tank 2 can be supplied without any of the mechanisms permitting water communication to the water cleaner main unit 1. These include the drain hole 24, check valve 22 and supporting components. In this embodiment, the water tank 2 has an open top and a substantially water-tight compartment formed by a bottom wall and one or more fully peripheral side walls. The water tank 2 essentially acts as a bucket. The top of the water tank 2 is typically fully open but could include a removable or hinged wall.

In this embodiment, the water cleaner main unit 1 has a feed water connector 14 that only needs to be connectable to a water source such as a city water tap. It need not be adapted for fluid communication with the water tank 2 directly. However, if the feed water connector 14 can be located on the water cleaner main unit 1 in such a location that it is accessible when the water tank 2 is placed upon the water cleaner main unit 1, then the water tank can still be placed upon and locked (using the locking handle 151 of the movable lock 15 and the recessed hole 231) to the water cleaner main unit 1. This may simply be for the benefit of taking up less footprint when in use. In such a configuration, an operator can access the water tank 2 for manual washing purposes and use the water cleaner main unit 1 for high pressure washing purposes.

When not in use, the water cleaner main unit 1 is nestable within the water tank 2 in similar fashion as described with the previous embodiment with reference to FIG. 9. This can be accomplished by the previously described stepped structure 17 in cooperation with the corresponding support structure 28, or any other suitable complementary support mechanism adapted to provide a retaining fit when the water cleaner main unit 1 is nested within the water tank 2.

The support structures generally provide one or more protrusions along the inner surface of the peripheral walls of the water tank 2. The support structures can either be complementary to the outer surface of the peripheral walls of the water tank 2, or could be adapted to constrain the perimeter of the inner surface of the water tank 2 so that the water cleaner main unit 1 will rest atop the protrusions. In either configuration, preferably the support structure is vertically part-way along the depth of the peripheral walls of the water tank 2 so that the water cleaner main unit 1 is nested snugly within the water tank 2, rather than being retained fully or predominantly atop the water tank 2. More preferably, the support structure is vertically deeper within the water tank 2 than the height of the peripheral walls of the water cleaner main unit 1 so that the water cleaner main unit 1 is fully nested within the water tank 2; that is, the top surface of the water cleaner main unit 1 is at or beneath the top surface of the water tank 2.

Alternatively or in addition to the use of protrusions, the water tank 2 and the water cleaner main unit 1 may have tapered walls so that at some point upon nesting, the water cleaner main unit 1 is snugly retained within the water tank 2.

It will be appreciated that the peripheral walls of the water cleaner main unit 1 could be defined as any four continuous walls, be it the four sides, or two sides plus the top and bottom walls, as defined with reference to the orientation of the water cleaner main unit 1 during operation. Thus, the water cleaner main unit 1 might actually be nested in the water tank 2 in what would best be considered as a sideways configuration.

Figure 10A:
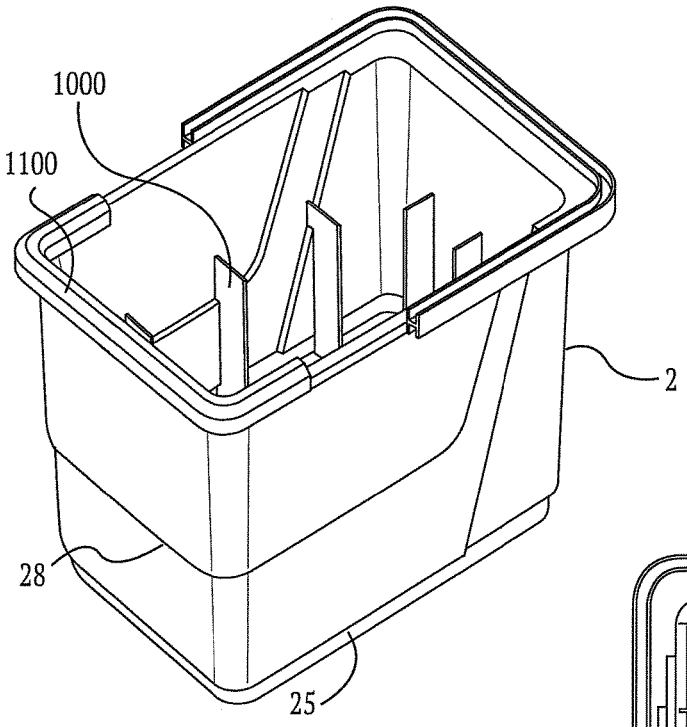
FIG. 10 illustrates schematic drawings of an embodiment of a water tank incorporating fins.
Figure 10B:
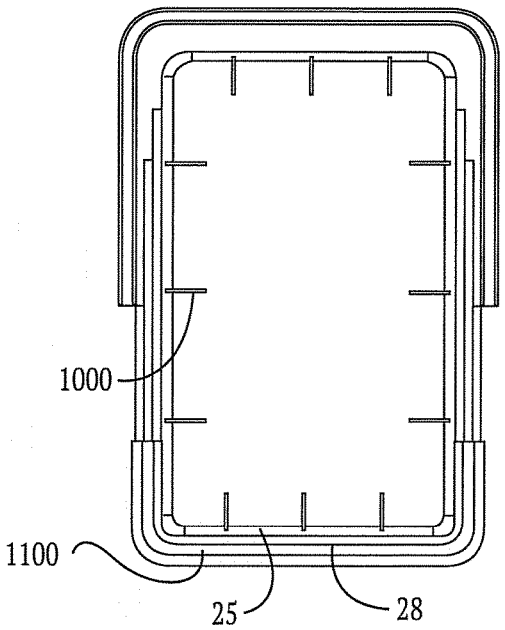

Referring now to FIG. 10, in which FIG. 10(*a*) illustrates a perspective view and FIG. 10(*b*) illustrates a top view of the water tank 2, another exemplary support structure using protrusions may, for example, include a plurality of vertically disposed fins 1000 along the inner periphery of the water tank 2 which extend into the water tank 2 by an amount sufficient to support the bottom of the water cleaner main unit. The fins 1000 are preferably formed part way along the depth of the inner surface of the periphery of the water tank 2.

Figure 11:
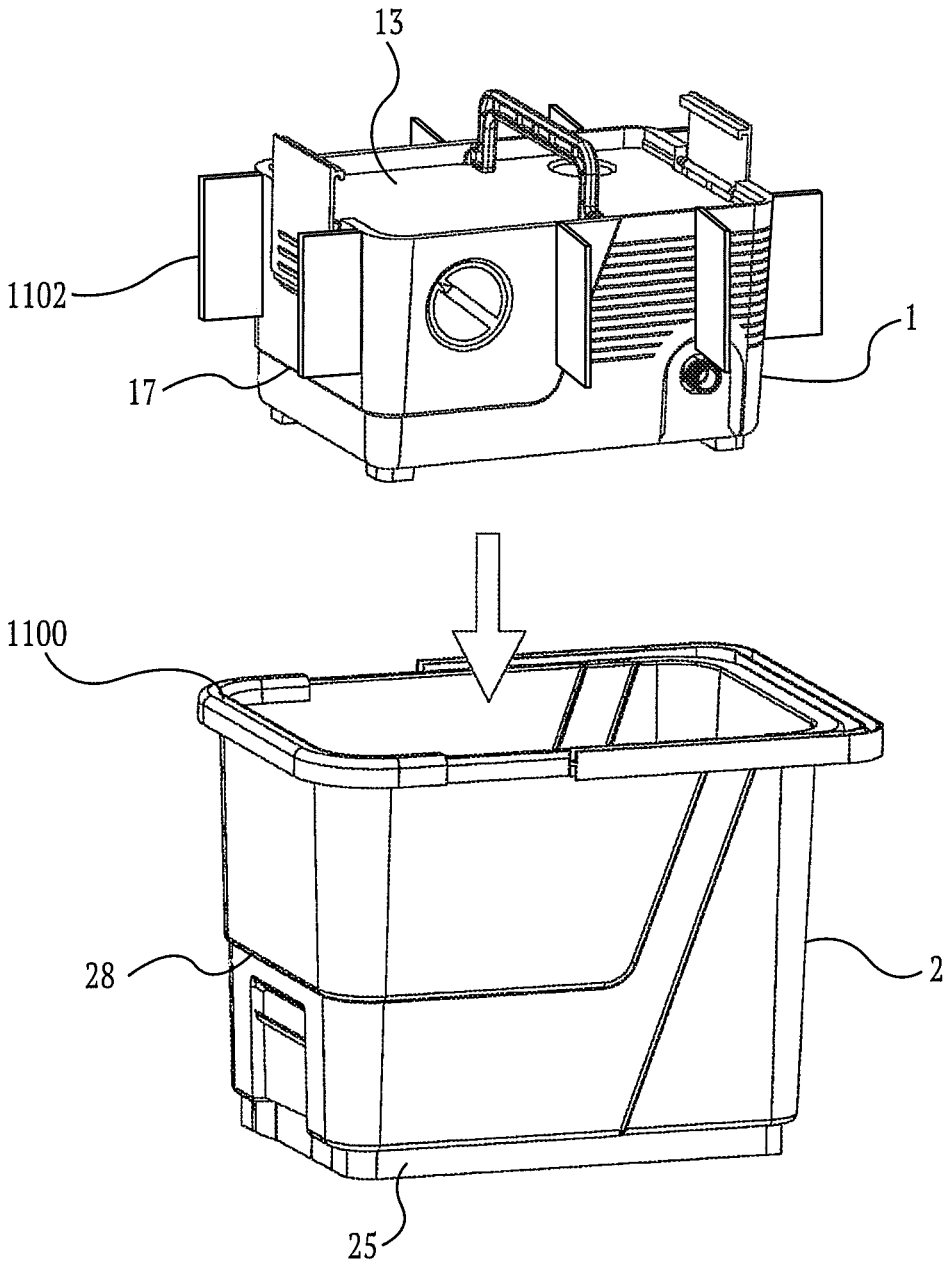
FIG. 11 illustrates schematic drawings of an embodiment of the water cleaner main unit incorporating fins.
Figure 12:
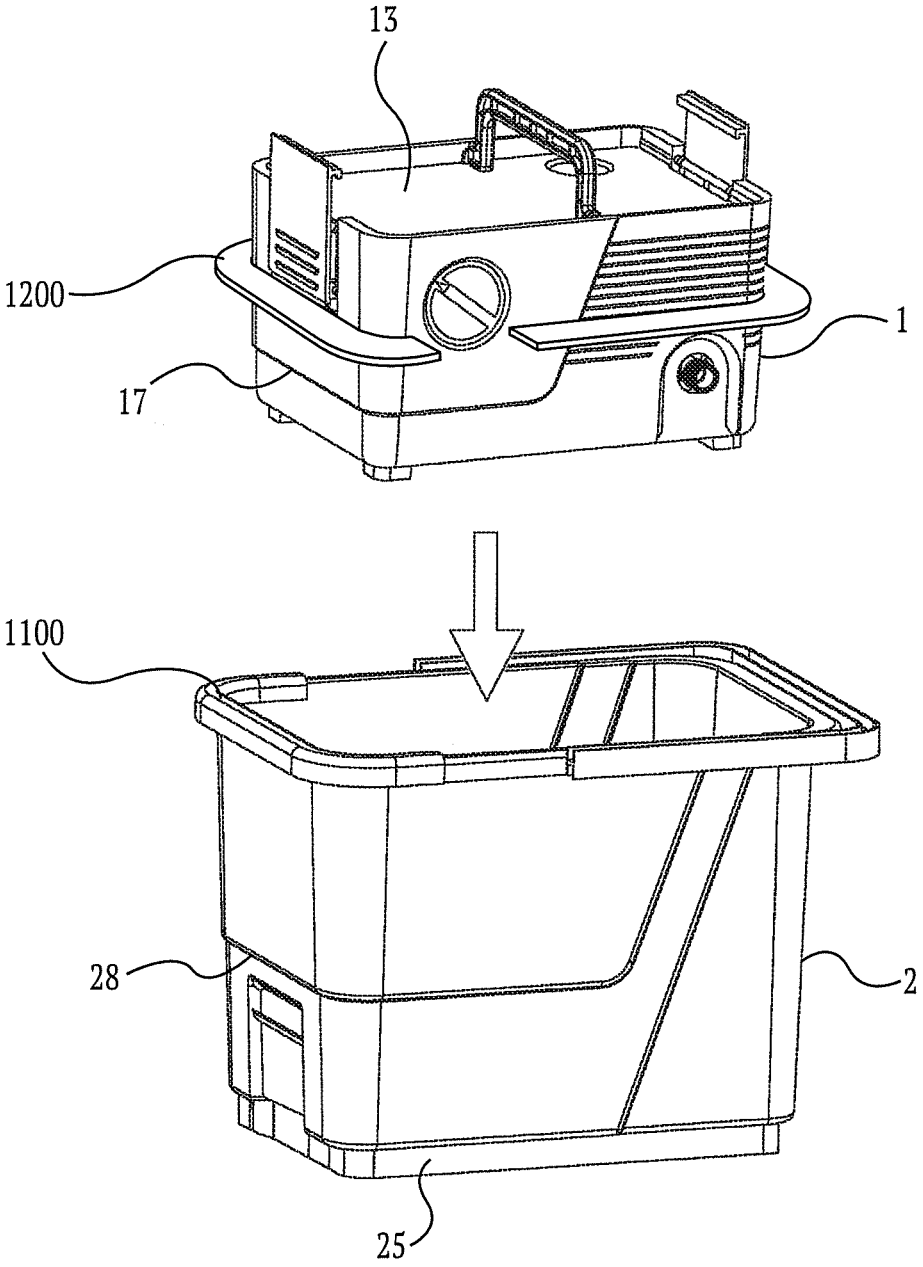
FIG. 12 illustrates schematic drawings of an embodiment of the water cleaner main unit incorporating a rim.
Figure 13:
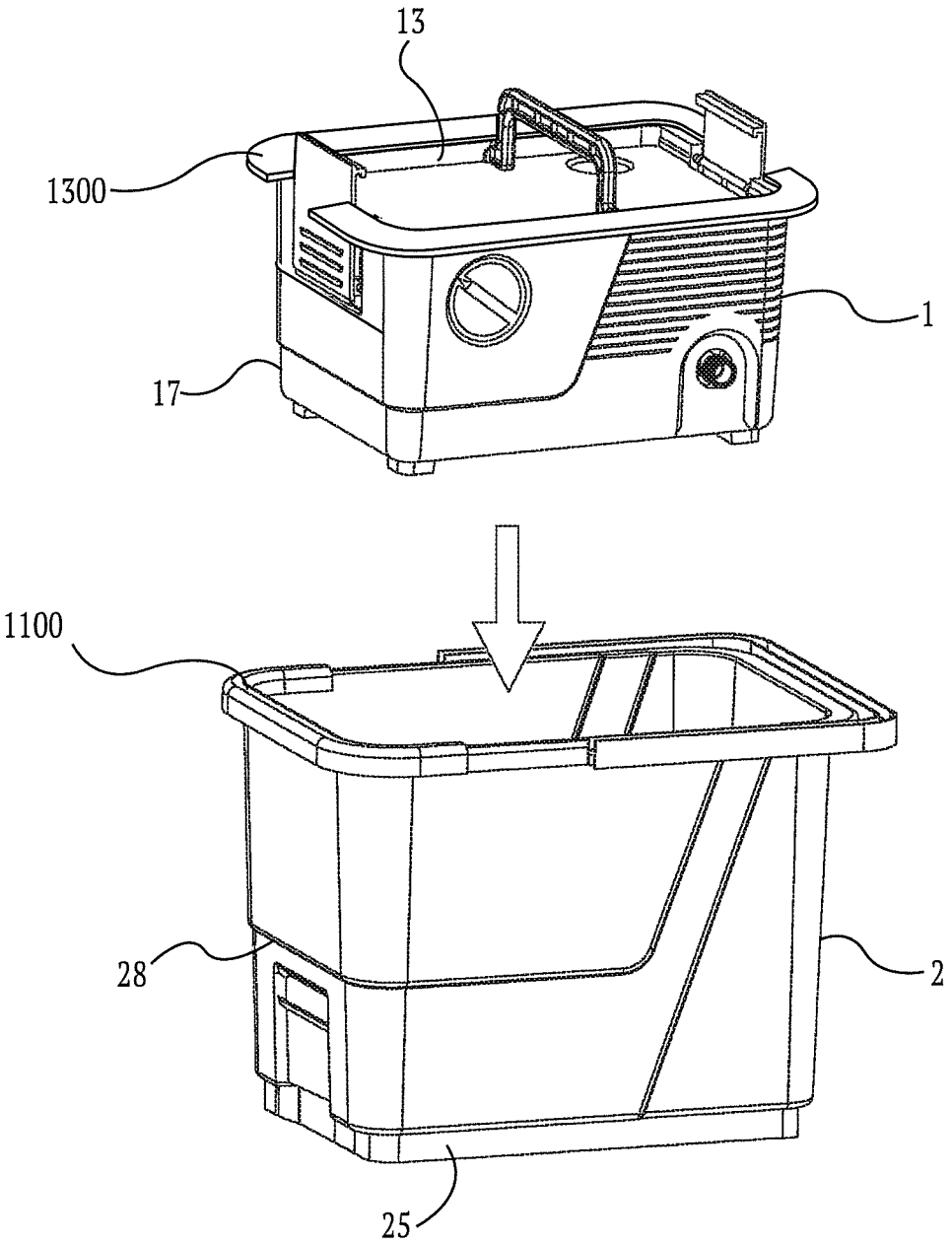
FIG. 13 illustrates schematic drawings of an embodiment of the water cleaner main unit incorporating a lip.

Referring now to FIGS. 11-13, further exemplary embodiments are shown. In these embodiments, the support structure of the water tank 2 is the upper lip 1100 of the water tank 2 defined by its peripheral walls. A corresponding water cleaner main unit 1 may have side walls that comprise protrusions which define a length and/or width of the water cleaner main unit 1 that is larger than the corresponding length and/or width of the water tank 2, so that the water cleaner main unit 1 sits upon the upper lip 1100. The protrusions are preferably closer to the top than the bottom of the water cleaner main unit 1 so that a portion of the water cleaner main unit 1 nests within the water tank 2. The protrusions may be fins 1102 disposed vertically along the side walls of the water cleaner main unit as shown in FIG. 11, a rim 1200 partially or fully encompassing the side walls of the water cleaner main unit as shown in FIG. 12, or a lip 1300 partially or fully encompassing the side walls of the water cleaner main unit as shown in FIG. 13. One characteristic of these embodiments is that the water tank can be manufactured simply as it does not require any unique support structure, since the support structure is defined by its existing upper lip 1100.

Although the foregoing embodiments contemplate rectangular peripheral walls for the water cleaner main unit 1 and water tank 2, such a shape is only one possible configuration; any suitable shape will suffice.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A high pressure water cleaner apparatus comprising:

a water cleaner main unit adapted in operation to output high pressure water to a water outlet disposed on a peripheral wall thereof given a low pressure input water supply, the water cleaner main unit having peripheral walls comprising top, bottom, and side walls, and having a hydraulic pump mounted therein in fluid communication with the water outlet for enhancing the pressure of supplied water, a regulator for regulating water pressure and water flow rate, and an electrical drive for driving said hydraulic pump; and a water tank comprising a bottom wall and peripheral walls, the water tank peripheral walls defining an opening dimensioned to receive therein the water cleaner main unit, and the water tank peripheral walls comprising a support structure disposed along an inner surface thereof complementary to an outer surface of the peripheral walls of the water cleaner main unit and disposed at a vertical depth in the water tank such that the water tank is adapted to receive through the opening the water cleaner main unit as a whole for nesting the water cleaner main unit snugly within the water tank to minimize storage space when the water cleaner main unit is not in operation and to provide a retaining fit for the water cleaner main unit, with the water cleaner main unit being spaced from the bottom wall of the water tank;

wherein said water cleaner main unit further comprises a receptacle located on a top side thereof for receiving said water tank.

2. The apparatus of claim 1, wherein the support structure is complementary to a stepped structure formed along the outer surface of the water cleaner main unit peripheral walls defined by its side walls.

3. The apparatus of claim 1, wherein the support structure is complementary to a stepped structure formed along the outer surface of the water cleaner main unit peripheral walls defined by two of its side walls, its top wall, and its bottom wall.

4. The apparatus of claim 1, wherein the support structure includes a plurality of vertical fins adapted to support the water cleaner main unit.

5. The apparatus of claim 1, wherein the support structure vertically extends along a portion of the water tank peripheral walls lower than an upper end of the water tank peripheral walls.

6. The apparatus of claim 1, wherein vertical space created between the support structure and an upper end of the water tank peripheral walls is greater than the height of the water cleaner main unit.

7. The apparatus of claim 1, wherein said water cleaner main unit further comprises a movable lock adapted for locking said water tank to said receptacle.

8. The apparatus of claim 7, wherein said movable lock comprises a locking handle pivotally connected to said water cleaner main unit and a hook located on the free end of said locking handle for hooking on said water tank.

9. The apparatus of claim 7, wherein said water tank further comprises a retainer located on the periphery for engaging said movable lock.

10. The apparatus of claim 9, wherein said retainer of said detachable water tank has a recessed hole for receiving said movable lock, and a transverse rod suspending in said recessed hole for engaging of said movable lock.

11. The apparatus of claim 10, wherein said movable lock comprises a locking handle pivotally connected to said water cleaner main unit and a hook located on the free end of said locking handle for hooking on said transverse rod of said retainer of said water tank.

12. The apparatus of claim 1, wherein said water tank further comprises a carrying handle pivotally connected to a top edge thereof.

13. The apparatus of claim 1, wherein said electrical drive consumes either one of AC power or DC power.

14. The apparatus of claim 13, wherein said water cleaner main unit further comprises a rechargeable battery mounted therein and electrically connected to said electrical drive.

15. The apparatus of claim 1, wherein said water tank further comprises a bottom flange fitting to said receptacle of said water cleaner main unit.

* * * * *